US011162202B2

(12) United States Patent
Magnusson

(10) Patent No.: US 11,162,202 B2
(45) Date of Patent: Nov. 2, 2021

(54) WASHING MACHINE WITH A FLEXIBLE WASHING COMPARTMENT HAVING ONE PROGRESSIVE INTENSITY WASHING ZONE

(71) Applicant: Roderinno AB, Nacka Strand (SE)

(72) Inventor: Fredrik Magnusson, Saltsjö-Boo (SE)

(73) Assignee: Roderinno AB, Nacka Strand (SE)

( * ) Notice: Subject to any disclaimer, the term of this patent is extended or adjusted under 35 U.S.C. 154(b) by 81 days.

(21) Appl. No.: 16/625,045

(22) PCT Filed: Jun. 11, 2018

(86) PCT No.: PCT/SE2018/050600
§ 371 (c)(1),
(2) Date: Dec. 20, 2019

(87) PCT Pub. No.: WO2019/004896
PCT Pub. Date: Jan. 3, 2019

(65) Prior Publication Data

US 2020/0216994 A1 Jul. 9, 2020

(30) Foreign Application Priority Data

Jun. 29, 2017 (SE) ..... 1750848-2

(51) Int. Cl.
*D06F 31/00* (2006.01)
*D06F 33/00* (2020.01)
(Continued)

(52) U.S. Cl.
CPC ..... *D06F 31/00* (2013.01); *D06F 33/00* (2013.01); *D06F 17/02* (2013.01); *D06F 29/00* (2013.01); *D06F 39/08* (2013.01)

(58) Field of Classification Search
CPC ..... D06F 31/00
See application file for complete search history.

(56) References Cited

U.S. PATENT DOCUMENTS 2,076,011 A 4/1937 Surface et al.
2,629,244 A 2/1953 Rand
(Continued)

FOREIGN PATENT DOCUMENTS

CN 1988839 6/2007
CN 103184668 7/2013
(Continued)

OTHER PUBLICATIONS

European Patent Office, Extended European Search Report for correspondence European Patent Application No. 18823141.9, dated Nov. 20, 2020.
(Continued)

*Primary Examiner* — Jason Y Ko
(74) *Attorney, Agent, or Firm* — Renner, Otto, Boisselle & Sklar, LLP

(57) ABSTRACT

Washing machine (1) for the washing of laundry such as clothes and textiles, which washing machine comprises one or more of the flexible washing compartments, wherein each also comprises one particular washing zone(s), in which particular washing zone, also referred to as a "progressive intensity washing zone", a flow of washing water typically containing detergents and/or one or more stain remover, is arranged to be oscillating, typically through a stacked layer of laundry or in other words "a stack of layers", such that progressive washing is obtained essentially of the whole content of the stacked laundry.

4 Claims, 3 Drawing Sheets

Figure 1A:
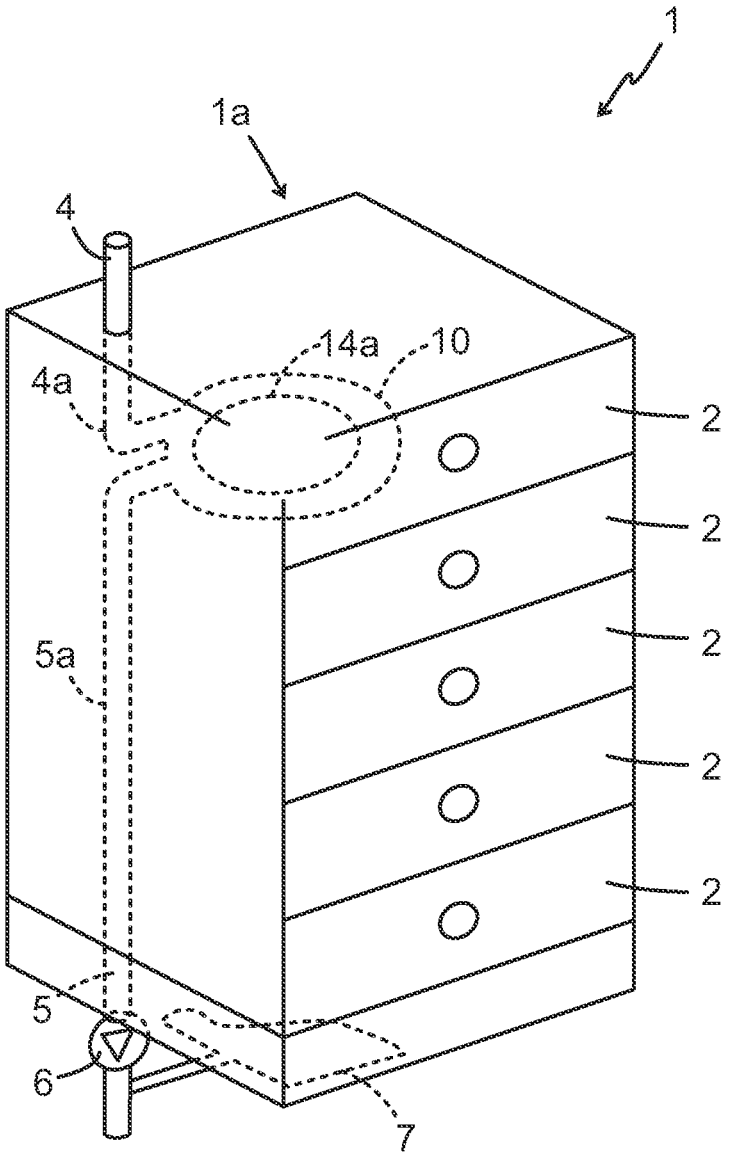

(51) Int. Cl.

| | |
|---|---|
| *D06F 17/02* | (2006.01) |
| *D06F 29/00* | (2006.01) |
| *D06F 39/08* | (2006.01) |

(56) References Cited

U.S. PATENT DOCUMENTS

| | | | |
|---|---|---|---|
| 4,095,288 | A | 6/1978 | Garlinghouse |
| 6,219,871 | B1 | 4/2001 | Frederick et al. |
| 2007/0136957 | A1 | 6/2007 | Shibano |
| 2012/0234054 | A1 | 9/2012 | Kim et al. |

FOREIGN PATENT DOCUMENTS

| | | | |
|---|---|---|---|
| DE | 36 12 548 | C1 | 7/1987 |
| EP | 2 633 113 | A1 | 9/2013 |
| JP | S52 94660 | A | 4/2001 |

OTHER PUBLICATIONS

International Search Report and Written Opinion for corresponding Patent Application No. PCT/SE2018/050600 dated Apr. 9, 2018.

WASHING MACHINE WITH A FLEXIBLE WASHING COMPARTMENT HAVING ONE PROGRESSIVE INTENSITY WASHING ZONE

FIELD OF THE INVENTION

The invention relates to a washing machine and in particular to a washing machine in which the laundry is washed inside an especially adapted flexible washing device that is arranged in a fluid tight manner in the washing machine.

BACKGROUND OF THE INVENTION

Today, there are known conventional washing machines having specific washing programs for more dirty laundry and other different programs for less dirty laundry. In particular, a higher temperature and/or more intense washing are required for more dirty laundry and less intense washing and/or lower temperature for less dirty laundry. Typically, the different specific programs, in particular more or less intense washing cannot be provided by the same specific program, but a choice must be made to either select more intense washing, or less intense washing. Thus, typically one has to choose between too intense washing of the whole content of the laundry even if only part of the complete laundry requires this intense washing, since the whole content of the laundry will be washed in the same way. There are also known sensor controlled washing machines for controlling how dirty or stained the laundry is, but also this is typically limited to the whole content of the laundry. Complicated and expensive sensor technology controls the washing machine such that more (stain removal) or dirty laundry or less intense (no stain removal) washing is provided. Thus, sensor technology is also typically expensive. Typically, the rotating drum's movement is controlled. Typically, the whole laundry is washed, not just a dirty and/or stained part thereof. This may cause unnecessary wear to the laundry not requiring more intense washing and/or stain removal.

Based on the above knowledge and related problems, it is a need to find a solution to the problems with the whole content of the laundry being washed the same even if not desired.

PRIOR ART

A conventional washing machine washes laundry, such as clothes, by wetting them, de-moisturizing them, wetting them again etc. until the laundry is clean. In order to accomplish this laundering conventional washing machines typically comprise a cylindrical drum in which the laundry may be alternately soaked and dried without having to be transferred between different chambers.

A less conventional washing machine without a conventional cylindrical drum is described in EP-B1-2 633 113.

SUMMARY OF THE INVENTION

An object of the invention is to provide a washing machine without a conventional cylindrical drum that washes the whole content of the laundry in a satisfying manner without too intense washing or too less intense washing of part of the laundry. Thus, part of the content of the whole content of the laundry can be washed differently to the rest of the laundry within the same washing compartment in the same washing machine.

The invention relates to a washing machine that comprises a housing, or an open frame, and having an inlet and outlet for water, and at least one pump. In contrast to conventional washing machines, the laundry is washed in at least one, or a plurality of flexible washing compartments arranged stacked onto each other, or side-to-side to each other, inside the housing, or the frame, of the washing machine. The flexible washing compartment(s) typically comprises one flexible and a hard plate, or alternatively two flexible membranes together making up a washing compartment, or is provided as a washing compartment. The plurality of flexible washing compartments is provided adjacent to each other in a plurality of drawers. The flexible washing compartments are each provided in the drawers by means of a respective suitable fluid tight connection for inlet and outlet of water and air. One or more of the flexible washing compartments each also comprises one particular washing zone(s), in which particular washing zone, also referred to as a "progressive intensity washing zone", a flow of washing water typically containing detergents and/or one or more stain remover, is arranged to be oscillating, typically through a stacked layer of laundry or in other words "a stack of layers", such that progressive washing is obtained essentially of the whole content of the stacked laundry. The oscillating flow of washing water in the one or more particular washing zone(s) has the effect that an upper layer, typically of more dirty and/or stained laundry is more intensely washed than a lower layer of laundry, typically less dirty and/or stained than the upper layer of laundry in the stacked layers of laundry.

Herein this disclosure, the term "upper layer" is considered to be the layer closest to an inlet and/or an outlet of the washing water or rinsing water.

A washing detergent may be provided directly to the washing compartment or via a separate compartment in the washing machine to be distributed into the washing compartment together with the water. After that the water has been added to the washing compartment the pump is activated.

Specifically, the invention relates to a washing machine for the washing of laundry such as fabrics, clothes and textiles. The washing machine has particular washing zones herein also called "progressive intensity washing zones", i. e. washing zones arranged to provide progressive intensity washing. An advantage of the at least one particular washing zone(s) arranged to provide progressive intense washing by means of an oscillating flow of water is that the whole content of the laundry can be washed at the same time progressively more or less intense in different parts of the whole content of laundry.

A progressive intensity washing zone may according to various embodiments of the present disclosure be equivalent to essentially a whole flexible washing compartment.

According to another embodiment the flow of water is oscillating essentially through the whole content of the laundry in the washing compartment.

An advantage is that several different types of laundry one type requiring more or less intense washing than another type can be washed at the same time in the same washing compartment, since the washing is progressive and more or less intense in different layers of the stacked laundry. The orientation of the stacked layers of laundry may be vertical or horizontal provided that the more intense washing is arranged to be provided in the layer nearest (referred to as an upper layer) the inlet and/or outlet and the less intense washing is arranged to be provided in the layer most far away from (referred to as a lower layer) the inlet and/or outlet. Thus, depending on the location of the inlet and/or the outlet, the stack of layers may be vertical or horizontal.

Further advantages of the invention will be apparent from the detailed description and the dependent claims.

SHORT DESCRIPTION OF THE DRAWINGS

Figure 1B:
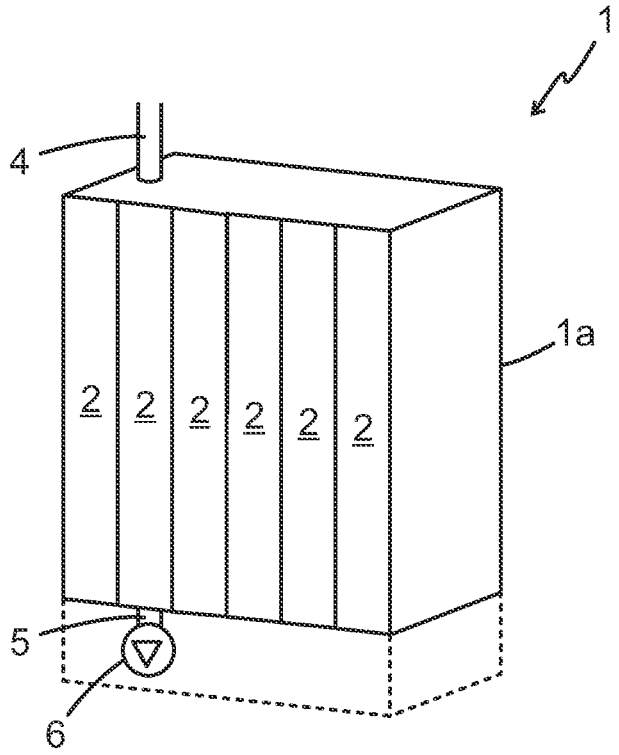
Figure 1C:
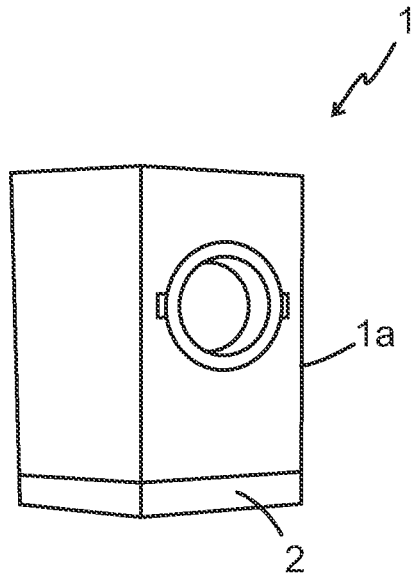

FIG. 1*a* shows, in a perspective view, an embodiment of a washing machine comprising a housing with a plurality of washing drawers each drawer comprising a flexible washing compartment embodied having a set of stain removal zones, FIG. 1*b* shows yet an alternative embodiment of a washing machine having a plurality of drawers arranged side-by-side, and FIG. 1*c* shows an alternative embodiment of a washing machine comprising one drawer combined with a conventional washing machine having a perforated metal washing drum.

Figure 2:
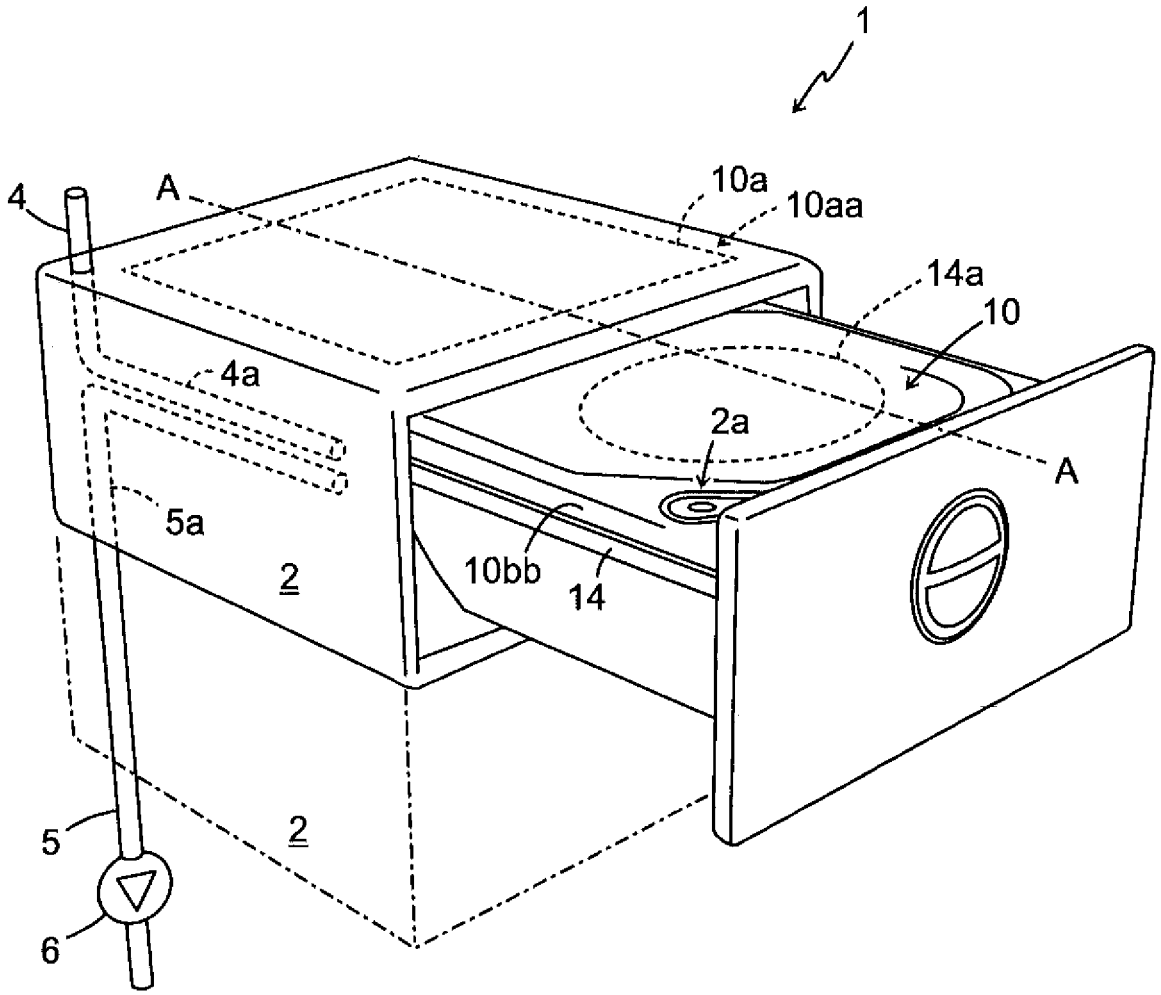
Figure 3:
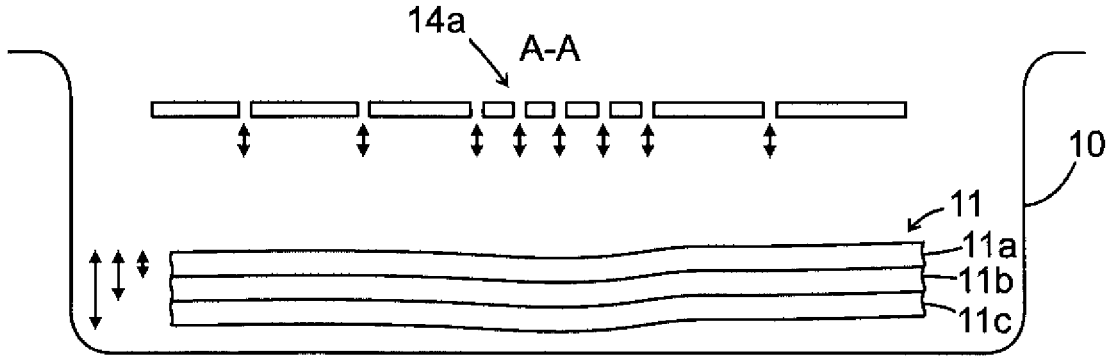

FIG. 2 shows, in a perspective view, a washing drawer, having a washing compartment of membrane type into which a one progressive intensity washing zone; and FIG. 3 shows, in a sectional view taken along line A-A in FIG. 2, wherein water is oscillating.

DETAILED DESCRIPTION OF EMBODIMENTS

A first embodiment of the washing machine according the invention is shown in FIG. 1*a*. In this figure, the components of the washing machine are only schematically shown, but will be shown in more detail in FIGS. 2-3. The washing machine 1 is suitable for the washing of several types of laundry such as clothes and textiles at the same time or in any desired manner.

FIG. 1*a* shows, in a perspective view, an embodiment of a washing machine comprising a housing with a plurality of washing drawers, FIG. 1*b* shows yet an alternative embodiment of a washing machine having a plurality of drawers arranged side-by-side, and FIG. 1*c* shows an alternative embodiment of a washing machine comprising one drawer combined with a conventional washing machine having a perforated metal washing drum, The housing may alternatively be embodied as an frame in all embodiments without departing from the invention.

Now is referred to FIG. 1*a*.

The washing machine shown in FIG. 1*a* comprises a housing 1*a*. The housing 1*a* comprises a plurality of drawers 2 provided as a set of washing drawers 2 stacked onto each other in the housing 1*a*, each drawer 2 comprising a respective flexible washing compartment 10, one or more flexible washing compartment 10 each having one progressive intensity washing zone 14*a* (schematically shown by a dashed line indicating the progressive intensity washing zone 14*a* in the upper most drawer 2) comprising a pair of flexible membranes providing the flexible washing compartment (not shown in FIG. 1*a*) or other water and air-tight closable seal, for washing laundry and arranged in the washing drawer 2.

Alternatively, a hard openable frame having a water- and/or air-tight seal can be provided instead of the flexible membranes.

The washing machine 1 comprises an inlet 4, for supplying clean washing water and an outlet 5, for disposal of used washing water. The washing machine 1 further comprises one or more pump(s) 6, in order to pump the used washing water out of the washing compartment. In order to supply clean water via the inlet 4 no pump is normally needed because the water will be provided from a pressurized and closed water system such as a public water supply system. Each washing compartment 10 in each drawer 2 (not all drawers 2 must, but may each contain a washing compartment) is connected to a pair of conduits 4*a*, 5*a* arranged to lead water from the inlet 4 via a conduit 4*a* to the respective washing compartment 10 arranged in each drawer 2 and to lead air and water away from the washing compartment 10 via a conduit 5*a*, by means of the pump 6. The pair of conduits 4*a*, 5*a* from each washing compartment 10 in each drawer 2 can be combined into one inlet 4 and outlet 5 for all washing compartments 10. The conduit 5*a* may also be connected to a reservoir 7 (schematically shown) inside the washing machine 1 for receiving used washing water and re-circulating the washing water one or more times back to the washing compartment 10. The washing machine 1 further comprise a progressive intensity washing zone 14*a*, essentially corresponding to the size of the washing compartment 10.

The pump 6 is utilized to create a pressure difference between the washing compartment 10 and its surroundings (in the drawer 2), typically a negative pressure, normally referred to as vacuum in the washing compartment 10 and atmospheric pressure in the drawer 2.

According to another embodiment, it is alternatively possible to arrange the washing compartments 10 side-by-side as shown in FIG. 1*b*.

Alternatively, to the embodiment shown in FIG. 1*a*, which comprises a plurality of drawers, it is possible to just have one drawer 2, potentially in combination with a conventional washing machine as shown in FIG. 1*c*, but not limited thereto. Alternative embodiments, combinations of one or more drawer(s) 2 with a conventional washing machine having a perforated metal washing drum at any side of the conventional washing machine are also possible without departing from the invention. A side-by-side combination may be an advantage for instance for washing shirts hanging.

Now is referred to FIG. 2, which shows, in a perspective view from above, a washing drawer 2 (for instance as illustrated in any one of the embodiments disclosed above) having a pair of conduits 4*a*, 5*a* for fluid tight connection of a respective flexible washing compartment 10 for washing stained laundry and being arranged in the washing drawer 2. The washing compartment 10 has one progressive intensity washing zone 14*a*. The washing compartment shown in this drawing comprise of two flexible membranes, herein an upper 10*a*, and a lower membrane 10*b* (not explicitly shown), which washing compartment 10 can be opened or closed in a fluid-tight manner by moving the drawer 2 out from the housing 1*a* for opening, or into the housing 1*a* for closing the washing compartment 10. This can be achieved since, the membranes are mounted in a respective upper 10*aa*, and lower 10*bb* frame, of which the upper membrane 10*a* can be moved, opened or closed. According to various embodiments, the washing compartment 10 may alternatively comprise one or more membranes, such as one flexible membrane provided on a rigid plate. The upper frame having the upper membrane 10*a* is arranged to be automatically opened when the drawer 2 is pulled out. This can be provided by having the frames 10*aa*, 10*bb* provided at a rail, wherein a pressure roll is arranged to press the upper frame 10*aa* having the upper membrane 10*a* against the lower frame 10*bb* having the lower membrane against each other when the drawer is pushed in and releasing the frames 10*aa*, 10*bb* to each other when the drawer is pulled out. Other mechanisms such as parallelograms, excenters, tracs, manual doors etc. providing opening or closing the washing compartment are obvious for the skilled person and the invention is by no means limited to this particular embodiment.

As disclosed the flexible washing compartment 10 can be made up of two flexible membranes 10*a*, 10*b*. The two membranes 10*a*, 10*b* are arranged on a frame preventing the washing compartment 10 to restrict across and along the frame, but still providing flat compression due to the pressure difference between the pressure inside the flexible washing compartment 10 and its surroundings in the drawer 2, typically the pressure inside the flexible washing compartment 10 is negative pressure and the pressure outside the flexible washing compartment is atmospheric pressure or positive pressure providing a pressure difference.

Now is referred to FIG. 3, which shows a sectional view taken along line A-A in FIG. 2, wherein water is oscillating.

According to an aspect, but not limited thereto, the laundry 11 is stacked and wetted in a longitudinal direction (schematically shown by double-headed arrows) when the pump 6 is turned on. The flexible washing compartment 10 also comprises one particular washing zone 14*a*, in which a flow of washing water typically containing detergents and/or one or more stain remover, is arranged to be oscillating (schematically illustrated by a plurality of equal double-headed arrows), typically through a stacked layer of laundry, such that progressive washing is obtained of the laundry. The oscillating flow of washing water in the one or more particular washing zone(s) 14*a* has the effect that an upper layer 11*a*, typically of more dirty and/or stained laundry is more intensely washed (illustrated by a long double-headed arrow) than a lower layer 11*b*, 11*c* of laundry, typically less dirty and/or stained than the upper layer of laundry in the stacked layers of laundry (illustrated by decreasing length of double-headed arrows.

Herein this disclosure, the term "upper layer" 11*a* is considered to be the layer 11*a* closest to an inlet 4*a* and/or an outlet 5*a* of the washing water.

The washing compartment 10 is connected to a pair of conduits 4*a*, 5*a*, which are schematically shown only. Typically, the washing compartment 10 is permanently fixed into the drawer 2 and permanently connected to the conduits 4*a*, 5*a*.

An advantage with the inventive solution is that it is simple and easy compared to today's known complicated and expensive sensor solutions The washing machine 1 can operate as follows.

One or more of the flexible washing compartments 10 are opened and filled with stacked laundry 11. Subsequently, water is provided via the inlet 4, and/or the conduit 4*a* to the flexible washing compartment(s) 10. The water is heated to a desired temp. The heating can be provided by means of a conventional heater (not shown) arranged inside or outside the washing machine 1.

A washing detergent may be provided directly into the washing compartment 10 or via a separate washing detergent compartment provided centrally in the washing machine 1 or in the specific drawer 2 to be distributed into the washing compartment 10 together with the water. After that the water has been provided to the washing compartment 10, the pump 6 is activated. Firstly, typically, but not limited to, the pump 6 is used to suck air from the washing compartment, to minimize the volume that has to be wetted, whereby the laundry 11 is compressed and soaked in water.

A flow of washing water typically containing detergents and/or one or more stain remover, is arranged to be oscillating, typically by means of the pump 6, oscillating through the stacked layers 11*a*, 11*b*, 11*c* of laundry 11 or in other words "a stack of layers", such that progressive washing is obtained essentially of the whole content (through all layers 11*a*, 11*b*, 11*c*) of the stacked laundry 11. The upper layer 11*a* is arranged for intense wash, the medium layer 11*b* for medium wash and the lower layer 11*c* for refresh.

The oscillating flow of washing water in the one or more particular washing zone(s) has the effect that an upper layer 11*a*, typically of more dirty and/or stained laundry is more intensely washed than a lower layer 11*b*, 11*c* of laundry, typically less dirty and/or stained than the upper layer 11*a* of laundry in the stacked layers of laundry. By means of the oscillating flow, the upper layer 11*a* receives the highest through-flow of washing water because of the arrangement nearest to the inlet/outlet 4, 5. Dirty and/or stained laundry of the upper layer 11*a* is hence placed nearest the inlet and/or outlet 4, 5, and the less dirty and/or stained layer of laundry 11 is placed most far away from the inlet/outlet in the lower layer 11*c*

The washing machine 1 washes the whole content, namely the stacked layers 11*a*, 11*b*, 11*c* of the whole laundry 11 in a satisfying manner without too intense washing or too less intense washing of part of the laundry. Thus, part of the content of the whole content of the laundry can be washed differently to the rest of the laundry within the same washing compartment 10 in the same washing machine 1.

Gradually the water is sucked out, and the same water may be returned for instance via the reservoir 7 and filter(s) provided in the washing machine to the washing compartment a couple of times before the water is exchanged and the cycle is repeated once again.

An example of the operation of the invention according to various embodiments will now be given. First, the laundry 11 is placed stacked (according to how dirty and/stained the laundry is) in a washing compartment 10 of any of the types described above and in one or more drawers 2 of the washing machine 1. In the shown embodiment, the laundry 11 is placed stacked in the washing compartment 10 inside the drawer 2. Then the washing compartment 10 is closed. After these measures, typically, but not limited to, first air is sucked out, creating vacuum or under pressure in the fibers and/or textiles of the laundry 11 then, clean washing water is supplied via inlet 4 to the washing compartment 10 replacing the under pressure, or vacuum and normalizing pressure and any air remaining in the washing compartment 10 is pumped out via the pump 6 such that the laundry 11 is soaked and compressed by the walls of the washing compartment 10. Once the laundry 11 is soaked it is possible to pump out the washing water from the washing compartment via the pump 6, wherein a certain negative pressure again is created in the washing compartment, and wherein the laundry 11 is further compressed by the atmospheric pressure (or alternatively positive over-pressure) outside the washing compartment 10. The washing becomes efficient thanks to the combination of pressure towards the laundry and the movement of the washing water and air bubbles, which penetrate in between the fibers of the laundry and deeply remove impurities. Pressure differences acting on air bubbles influences the air bubbles to change in size, which implies that the air-bubbles on a micro-level "pump" the water back and forth inside the fibers. Air is elastic contrary to water, such that water is transferred when the air bubbles grow or shrink. If a micro-bubble is stuck inside a hollow fiber, the fiber will pump clean inside the fiber. At the lowest pressure, the air bubbles are as large as possible. Further, the laundry may be kneaded by the walls of the washing compartment which increases the washing efficiency. Once the washing water has been re-circulated via filter a number of times, the water sucked out to the desired degree, the rinsing water is supplied to the washing compartment. The purpose of the rinsing water is e.g. to perform a final cleaning of the laundry and to remove any remainders of the washing detergent. Further, rinsing fluid and/or fabric softener, which softens and/or gives the laundry a pleasant fragrance, may be supplied together with the rinsing water. The rinsing water is removed from the washing machine in the same manner as the washing water.

The invention claimed is:

1. A washing machine for washing laundry, which washing machine comprises a housing, wherein the housing comprises:

an inlet, for supplying washing water, an outlet, for disposal of washing water, and a pump, for pumping the washing water and air, the housing further comprising at least one washing drawer, each of the at least one washing drawer having a pair of conduits for fluid tight connection of a respective flexible washing compartment arranged in the washing drawer for washing laundry, wherein each of the at least one washing drawer of the housing is arranged to lead water from the inlet of the housing via a first conduit of the pair of conduits to the respective flexible washing compartment arranged therein and, by the pump and via a second conduit of the pair of conduits, to pump air and water out from the respective flexible washing compartment in order to create a pressure difference inside the washing compartment with respect to the surrounding pressure and by that emptying the flexible washing compartment of washing water and air, wherein the respective flexible washing compartment each also comprises:

a respective upper membrane and lower membrane of which the upper membrane is configured to be opened and closed in a fluid-tight manner by moving the drawer out from the housing for opening, or into the housing for closing the flexible washing compartment, and a washing zone in which a flow of water is oscillable by action of the pump, and wherein the washing zone is configured to hold stacked layers of laundry oriented vertically or horizontally, and wherein the inlet and outlet are arranged in relation to the washing zone to provide a more intense washing in the layer nearest the inlet and the outlet and a less intense washing in a layer furthest away from the inlet and the outlet such that the washing is progressive and more or less intense in different layers of the stacked layers of laundry.

2. The washing machine according to claim 1, wherein an increased flow of washing water is arranged to be oscillating flowing through the whole of the particular washing zone.

3. The washing machine according to claim 1, wherein the pump is arranged to oscillate the washing water and/or rinsing water.

4. The washing machine according to claim 1, wherein the washing zone corresponds to the washing compartment.

* * * * *